US010634364B2

(12) United States Patent
Both et al.

(10) Patent No.: US 10,634,364 B2
(45) Date of Patent: Apr. 28, 2020

(54) OPERATING DEVICE FOR A DOMESTIC APPLIANCE HAVING A STABLY POSITIONED ANNULAR OPERATING-ELEMENT FRONT PART

(71) Applicant: BSH Hausgeräte GmbH, Munich (DE)

(72) Inventors: Marianne Both, Kopenhagenstraße (DE); Stefan Brunn, München (DE); Iris Costenoble, Palling (DE); Andreas Dachs, Neufraunhofen (DE); Ulrich Goss, München (DE); Bernd Martin, Stein an der Traun (DE); Robert Sachon, München (DE); Matthias Sorg, Wonneberg (DE)

(73) Assignee: BSH Hausgeräte GmbH, Munich (DE)

( * ) Notice: Subject to any disclaimer, the term of this patent is extended or adjusted under 35 U.S.C. 154(b) by 488 days.

(21) Appl. No.: 15/502,509

(22) PCT Filed: Aug. 12, 2015

(86) PCT No.: PCT/EP2015/068573
§ 371 (c)(1),
(2) Date: Feb. 8, 2017

(87) PCT Pub. No.: WO2016/026754
PCT Pub. Date: Feb. 25, 2016

(65) Prior Publication Data

US 2017/0234547 A1 Aug. 17, 2017

(30) Foreign Application Priority Data

Aug. 19, 2014 (DE) ..... 10 2014 216 389

(51) Int. Cl.
*F24C 7/08* (2006.01)

(52) U.S. Cl.
CPC ..... *F24C 7/08* (2013.01); *F24C 7/082* (2013.01)

(58) Field of Classification Search
USPC ..... 219/412, 457.1, 507, 508; 345/173, 156, 345/184, 170, 171, 172; 700/83
See application file for complete search history.

(56) References Cited

U.S. PATENT DOCUMENTS 2,935,583 A * 5/1960 Howell ..... H01H 36/00 200/19.36
3,073,939 A * 1/1963 Clapp ..... H01H 89/04 219/508

(Continued)

FOREIGN PATENT DOCUMENTS

CN 1884921 A 12/2006
DE 1817390 A1 7/1970

(Continued)

OTHER PUBLICATIONS

International Search Report PCT/EP2015/068573 dated Nov. 2, 2015.

(Continued)

*Primary Examiner* — Jimmy Chou
(74) *Attorney, Agent, or Firm* — Michael E. Tschupp; Andre Pallapies; Brandon G. Braun

(57) ABSTRACT

An operating device for a domestic appliance includes an electronic display field, a guide, and an operating element which is movable relative to the electronic display field to set operating conditions of the domestic appliance. The operating element is comprised of multiple parts and includes a sliding ring and a front part resting on the sliding ring. The front part and the sliding ring are coupled to the guide such that the front part is rotatable in a guided manner relative to the sliding ring by the guide.

21 Claims, 2 Drawing Sheets

(56) References Cited

U.S. PATENT DOCUMENTS 3,384,735 A * 5/1968 Linger ..... H05B 3/681 219/448.11
3,406,278 A * 10/1968 Bassett, Jr. ..... F24C 15/106 219/457.1
3,412,235 A * 11/1968 Hild ..... H05B 1/0216 219/398
3,509,319 A * 4/1970 Perl ..... A47J 27/004 219/432
3,641,968 A * 2/1972 Grayson ..... H01H 9/16 116/302
3,808,402 A * 4/1974 Rea ..... A21B 1/40 219/408
4,140,048 A * 2/1979 Grove ..... A47J 37/0814 219/489
4,158,216 A * 6/1979 Bigelow ..... H03K 17/98 200/600
4,233,593 A * 11/1980 Bigelow ..... G06F 3/03547 340/870.37
4,318,095 A * 3/1982 Fukuoka ..... H03M 1/26 318/614
4,849,595 A * 7/1989 Fowler ..... H05B 6/6452 219/719
5,920,131 A * 7/1999 Platt ..... F24C 7/082 307/104
6,140,627 A * 10/2000 Jeon ..... H05B 6/6435 200/38 FA
6,153,837 A * 11/2000 Garcia ..... F24C 7/083 200/18
6,196,943 B1 * 3/2001 Chen ..... B25B 21/00 475/254
6,498,326 B1 * 12/2002 Knappe ..... H05B 3/746 219/507
6,710,565 B2 * 3/2004 Maeda ..... B60K 37/06 200/501
6,812,435 B2 * 11/2004 Schilling ..... F24C 7/083 200/18
6,838,785 B2 * 1/2005 Schilling ..... F24C 7/083 219/660
6,903,652 B2 * 6/2005 Noguchi ..... B60R 11/02 340/425.5
6,966,781 B1 * 11/2005 Bullinger ..... H01R 13/6205 439/289
7,044,023 B2 * 5/2006 Toniolo ..... F16K 31/535 122/504
7,222,979 B1 * 5/2007 Popowich ..... H01H 19/025 200/316
7,238,929 B2 7/2007 Baier
7,248,252 B2 * 7/2007 Amari ..... B60K 37/06 345/160
7,339,128 B2 * 3/2008 Yen ..... H05B 33/0842 200/313
7,463,241 B2 * 12/2008 Ushimaru ..... G05G 9/04796 345/156
7,564,150 B2 * 7/2009 Baier ..... H03K 17/98 307/115
7,642,673 B2 * 1/2010 Baier ..... F24C 7/082 307/104
7,642,886 B2 * 1/2010 Boss ..... F24C 7/083 200/341
8,106,733 B2 * 1/2012 Nakasuji ..... H01H 36/0066 219/457.1
8,136,442 B2 * 3/2012 Strutin-Belinoff ..... F24C 7/082 219/506
8,192,319 B2 * 6/2012 Rh me ..... H01C 10/14 475/196
8,217,742 B2 * 7/2012 Trudeau ..... G01D 5/145 200/4
8,243,025 B2 * 8/2012 Fibaek ..... G06F 3/0362 345/170
D669,865 S * 10/2012 Gilbert ..... D10/49
D669,866 S * 10/2012 Gilbert ..... D10/49
8,440,945 B2 * 5/2013 Blumenthal ..... F24C 7/083 200/18
8,461,727 B2 * 6/2013 Baier ..... F24C 7/083 307/149
8,502,092 B2 * 8/2013 Chou ..... H01H 25/065 200/14
8,835,814 B2 * 9/2014 Apetauer ..... F24C 7/083 219/443.1
10,082,925 B2 * 9/2018 Goss ..... A47L 15/4293
10,345,514 B2 * 7/2019 Kozinski ..... G02B 6/0095
2002/0171626 A1 * 11/2002 Nojima ..... G10H 1/0091 345/156
2003/0028271 A1 * 2/2003 Peterson ..... D06F 33/02 700/85
2003/0204406 A1 * 10/2003 Reardon ..... G06Q 30/02 705/313
2004/0132498 A1 * 7/2004 Clabunde ..... G05G 9/047 455/566
2004/0257339 A1 * 12/2004 Takahashi ..... G06F 3/016 345/156
2005/0016988 A1 * 1/2005 Harwell ..... F24C 7/082 219/482
2005/0184046 A1 * 8/2005 Sterling ..... F24C 15/105 219/483
2005/0189820 A1 * 9/2005 Blumenthal ..... F24C 7/083 307/104
2005/0212781 A1 * 9/2005 Clapper ..... G06F 1/181 345/184
2006/0012584 A1 * 1/2006 Vassallo ..... G06F 3/016 345/184
2007/0152988 A1 * 7/2007 Levin ..... G06F 3/016 345/184
2007/0181410 A1 * 8/2007 Baier ..... F24C 7/082 200/17 R
2008/0029369 A1 * 2/2008 Weigold ..... H03K 17/97 200/17 R
2008/0068117 A1 * 3/2008 Boss ..... F24C 7/083 335/206
2008/0234855 A1 * 9/2008 Haas ..... G05B 19/409 700/180
2008/0282902 A1 * 11/2008 Dayton ..... F24C 7/082 99/331
2009/0009491 A1 * 1/2009 Grivna ..... G06F 3/033 345/184
2009/0084220 A1 * 4/2009 Morizono ..... B60H 1/0065 74/501.6
2010/0000417 A1 * 1/2010 Tetreault ..... A47J 37/08 99/325
2010/0012647 A1 * 1/2010 Baier ..... F24C 7/083 219/482
2010/0164873 A1 * 7/2010 Senft ..... G01D 5/34 345/170
2010/0253653 A1 * 10/2010 Stambaugh ..... H03K 17/9622 345/184
2010/0309116 A1 * 12/2010 Oh ..... G06F 3/0234 345/156
2011/0148775 A1 * 6/2011 Rudolph ..... F24C 7/086 345/173
2011/0254710 A1 * 10/2011 Nakade ..... H01H 25/041 341/35
2012/0056761 A1 * 3/2012 Sano ..... G05G 1/08 341/35
2012/0146896 A1 * 6/2012 Eckl ..... G06F 3/04815 345/156
2012/0241654 A1 * 9/2012 Clifford ..... F16K 31/60 251/96
2012/0305820 A1 * 12/2012 Bollman ..... F24C 3/126 251/213
2013/0249847 A1 * 9/2013 Goss ..... F24C 7/082 345/173
2013/0268098 A1 * 10/2013 Goss ..... A47L 15/4293 700/83
2014/0021024 A1 1/2014 Heimann et al.
2015/0300846 A1 * 10/2015 Both ..... F24C 7/082 250/231.14

(56) References Cited

U.S. PATENT DOCUMENTS

| | | | | |
|---|---|---|---|---|
| 2016/0162037 | A1* | 6/2016 | Park | G06F 3/017 345/156 |
| 2016/0170436 | A1* | 6/2016 | Farrar | G01D 5/30 345/173 |
| 2016/0188025 | A1* | 6/2016 | Park | G06F 3/041 52/784.15 |
| 2017/0235383 | A1* | 8/2017 | Goss | G05G 1/015 345/184 |
| 2017/0242573 | A1* | 8/2017 | Goss | F24C 7/085 |

FOREIGN PATENT DOCUMENTS

| | | | |
|---|---|---|---|
| DE | 10140505 | A1 | 3/2003 |
| DE | 10255676 | A1 | 6/2004 |
| DE | 102012213693 | A1 | 2/2014 |
| DE | 102013212815 | A1 | 1/2015 |
| EP | 1258878 | A2 | 11/2002 |
| WO | 2012080156 | A1 | 6/2012 |

OTHER PUBLICATIONS

National Search Report DE 10 2014 216 389.7 dated Jun. 3, 2015.
National Search Report CN 201580044342.6 dated May 8, 2018.

* cited by examiner

OPERATING DEVICE FOR A DOMESTIC APPLIANCE HAVING A STABLY POSITIONED ANNULAR OPERATING-ELEMENT FRONT PART

CROSS-REFERENCES TO RELATED APPLICATIONS

This application is the U.S. National Stage of International Application No. PCT/EP2015/068573, filed Aug. 12, 2015, which designated the United States and has been published as International Publication No. WO 2016/026754 A1 and which claims the priority of German Patent Application, Serial No. 10 2014 216 389.7, filed Aug. 19, 2014, pursuant to 35 U.S.C. 119(a)-(d).

BACKGROUND OF THE INVENTION

The invention relates to an operating device for a domestic appliance with an electronic display field and an operating element, which can be moved in relation to the display field in order to set operating conditions of the domestic appliance. Furthermore the invention relates to a domestic appliance with a corresponding operating device.

Operating devices for domestic appliances, for instance ovens, washing machines, tumble dryers, dishwashers or suchlike are known in a variety of embodiments. In addition, touch-sensitive operating devices with touch zones are likewise known, such as operating elements in the form of rotating switches, push-button switches and thus operating elements of this type, which have to be moved in relation to a display unit in order to set operating conditions.

A compact design at the same time as a user-friendly operability and an intuitively perceptible presentation of information is difficult or even impossible particularly with operating devices of this type with movable operating elements in combination with electronic display fields as display units. The cited components must be arranged separately and also at a distance from one another. Furthermore, operating elements of this type are known to be very large and bulky and as such on the one hand require significant space. This also applies to their general size as a knob and thus cylinder and also to the degree to which they protrude forwards out of the operating device in order that they can be gripped and rotated.

A generic operating device is known from WO 2012/080156 A1.

BRIEF SUMMARY OF THE INVENTION

The object of the present invention is to create an operating device for a domestic appliance and a domestic appliance with a corresponding operating device in which a front part of an operating element is positioned stably and can still be rotated easily.

This object is achieved by an operating device and a domestic appliance according to the independent claims.

An inventive operating device for a domestic appliance comprises an electronic display field and an operating element, which can be moved in relation to the display field in order to set operating conditions of the domestic appliance. The operating element is embodied with multiple parts and has a sliding ring and an in particular annular front part which rests thereon. An important idea behind the invention is that the front part and the sliding ring are coupled to a guide and by means of the guide the front part can be rotatably guided in relation to the sliding ring. By means of this embodiment, the front part can be secured against falling out and still rotated easily.

The guide preferably has a groove which is open in the radial direction of the front part and comprises at least one engaging element for engaging into the groove. This is a simple coupling to secure the front part and is nevertheless durably functionally reliable and permits a smooth rotation of the front part.

The engaging element is preferably embodied resiliently when viewed in the radial direction of the sliding ring and in the radial direction of the front part. This is particularly advantageous since the coupling and decoupling are thus permitted in a non-destructive manner and furthermore also allow the easy and compensatory relative movement of the front part relative to the sliding ring without excessive friction occurring during rotation and this blocking the rotational movement.

In the state coupled to the groove the engaging element is preferably arranged prestressed in the groove, in particular arranged radially prestressed therein. This particularly aids the play-free guiding and permits a very precise and positionally-accurate rotational movement.

In particular, the groove on the front part is embodied on a radially inner shell side of the front part. The coupling and motion control is improved as a result and on account of the gravitational force when the front part is oriented vertically, the front part also in effect rests on the engaging element, resulting in a bearing or lifting support of the front part.

The sliding ring preferably has a slide plate, which is arranged behind the front part when viewed in the axial direction of the operating element, wherein the sliding ring has a holding web which extends in an axial direction and overlaps with the front part, wherein at least one engaging element which extends radially is embodied on the holding web and extends into the groove in the radial direction. This means that on the one hand the coupling and also the easy, radially and axially wobble-free relative movement of the front part in relation to the sliding ring is achieved in particular.

The sliding ring is preferably arranged with a fixed position on the control panel. In particular, the sliding ring is glued or welded or hot-stamped on the control panel. This means that the relative maneuverability of the front part compared to the sliding ring is aided and achieves the very precise and play-free guiding of the front part and produces a mechanically stable arrangement with a durable secure fit.

The operating element has a front part, which preferably has a top side that is inclined inward. This front part can be moved in relation to the display field. By means of this embodiment in respect of the shaping of the front part on the one hand and the arrangement on the other hand, a very compact operating device is ensured especially in respect of the components of the electronic display field and of the operating element.

The ring form of the front part and in particular of the top side that is inclined inward ensures that it can be touched and actuated by a user's finger in a particularly easy and precise manner. The annular front part can be rotated very precisely by a user.

Provision can also be made for the front part to have a full circle surface, which is inclined inward and thus in effect represents a full funnel.

An electronic display field is understood in particular to mean a display on which information can be displayed dynamically so as to alternate. This may be information comprising letters and/or digits and/or symbols.

Preferably the operating element is fundamentally embodied as a ring. A form as a full cylinder or suchlike is therefore no longer provided. On the one hand this means that material can be saved; in fact the basic operating principle can be designed so that, compared to the prior art, the cylinder of the operating knob to be gripped on the shell side is no longer present here, but instead it is precisely the front panel or top side of this annular front part that is touched by a user and this front part is then rotated. In effect, provision is thus made in principle for another surface to be touched by the user and for the movement of the operating element associated therewith. In this respect the ring form produces a very appropriate form as it provides an operating element which has a relatively large diameter. This may be larger than conventional cylinder-shaped operating knobs. The inventive operating element can then also be brought very accurately into a desired rotational position in order to set the desired operating conditions especially by means of the annular embodiment of the front part and the contact provided with the top side. This is not possible with conventional cylinder-shaped operating elements, because on the one hand the rotatability in this regard when touching merely the front panel of this hollow cylinder is difficult and associated with greater mechanical force and furthermore does not effect free movement and may result in incorrect settings. In this regard the conventional cylinder-shaped operating knobs are designed such that they have a smaller diameter, so that the front panel of such cylinder-shaped operating knobs is also relatively small and on account of the force paths in respect of contact with a finger can then also only be rotated with difficulty or not at all.

The operating element is preferably embodied as a rotary selector. This means that by setting different rotational positions, the associated and desired operating conditions can be selected and/or set.

Setting operating conditions generally involves both selecting functional subunits of a domestic appliance and also setting values of operating parameters of these functional subunits. For instance with an oven, provision can be made, as the functional subunit, to operate the cooking compartment or a cooking zone. Furthermore, a setting of an operating parameter, for instance of the temperature, the cooking zone or the cooking compartment, can be performed accordingly.

The annular front part rests in particular in contact with the sliding ring. The sliding ring is manufactured from a specific material, which aids the maneuverability of the annular front part with as little friction as possible. As a result, a particularly easy and user-friendly rotation of the front part is possible. In respect of the material embodiment of the sliding ring, conventional and known polymer materials can be provided, which have particularly low friction.

Provision is preferably made for the operating element embodied as a ring to have magnets, wherein when the magnets interact with stationary metal elements, in particular an annular metal spider, an associated operating setting of the domestic appliance can be registered as a function of a relative movement of the ring, in particular of the annular front part, in relation to the metal elements. The magnets can preferably be attached on the rear of the front part or embedded therein. The rotational position of this front part in relation to the metal elements, in particular the annular metal spider, can thus be detected on account of this interaction and evaluated by a control unit of the operating device.

Provision is made particularly advantageously for the metal elements to be arranged on the rear of a cover which covers the front of the display field at least in regions.

In respect of the metal spider, which is preferably embodied in one piece, the diameter preferably corresponds essentially to the diameter of the sliding ring and/or of the annular front part.

The metal spider preferably has a thickness of less than 1 mm, preferably 0.7 mm. It is preferably embedded or arranged in a depression on the rear of the cover. The flat embodiment of the operating device is favored as a result. This additionally means that the metal spider is held in a secure fit and is mechanically stable.

Provision is preferably made for the operating element embodied as a ring to be made permeable, at least in regions, to light in the spectral range which is visible to humans. Additional optical information can be presented to a user by means of an embodiment of this type. Aside from identifying the operating element for a user in respect of the general position of the operating element in the operating device, this means that an operating condition can furthermore also be optically displayed individually. Provision can be made for the annular front part to be capable of being entirely backlit or for only ring sections to be correspondingly backlit.

Provision is preferably made for the operating element to be embedded in a plate-shaped cover which is arranged in front of the display field and is particularly permeable to the light of the display field. This cover is therefore multifunctional since on the one hand it functions as a support for the operating element and receives this operating element with minimal installation space. On the other hand it serves as protection for the display field, protecting it from wear or damage. By means of the light-permeable embodiment an arrangement with particularly minimal installation space in respect of the surface area can also be provided here.

Provision is preferably made for the annular front part, in particular at least its outer edge, to project in a raised manner beyond the top side of the cover, in particular by less than 1.5 mm, in particular by less than 1 mm. This is an advantageous embodiment which is especially worth highlighting. The operating element can consequently be gripped and touched in a particularly secure manner especially in conjunction with the funnel-shaped top side of the annular front part or the top side that is inclined obliquely inward and this minimal projection of the outer edge. On the other hand this means that it is possible to prevent the finger from unintentionally passing over too much of the exterior of the cover. This means that on the one hand unwanted dirt on this exterior and an unwanted slipping of the finger from the top side of the annular front part of the operating element can be avoided. By means of this embodiment of the operating element, the motion control is particularly easy and user-friendly.

Finally it should be mentioned in this context that the design of the operating device or the depth of its installation space is also particularly minimized by this embedding of the front part and this minimal projection of only the outer edge of this annular front part.

The operating element embodied as a ring is preferably arranged in a groove, which opens forward in an axial direction, in the front panel of the cover. This means that in particular the annular front part and the sliding ring are arranged in this front groove. This also means that its positioning can also be made easier in mechanical terms and guided particularly effectively especially in respect of the relative rotational movement.

Provision is preferably made for a groove to be embodied on the exterior or front panel of this cover, into which groove the sliding ring and the annular front part are countersunk. A groove in which the metal spider is positioned is preferably embodied congruently on the rear of this cover. In particular, in a first embodiment provision can be made for material of the cover also to be arranged between the two grooves and thus also between the metal spider and the sliding ring.

In an alternative embodiment provision can be made for the cover to have an entirely continuous recess. The cited components of the operating element can then be introduced into this hole recess and a rear cover, for instance a plate or a plastic part, can be provided which seals the construction from the rear. Provision can likewise be made for a further corresponding glass part then to be introduced into this hole and fastened, with the cited components of the operating element then being arranged therein.

Aside from the multi-part embodiment of the operating element already cited, provision can however also be made for a single-piece or single-part embodiment.

Provision can also be made here for a possibility of backlighting, already mentioned above, wherein correspondingly thinner rings or ring sections, points or segments could then be optically displayed in the ring. This means that indications of a setting of an operation or the sequence of a program of the device can be given. This could also be displayed inside or outside of the ring or digitally in the display field, or shown optically.

Provision is preferably made for the cover to be a glass plate. This has in particular a thickness of less than 10 mm, in particular less than 8 mm, preferably between 6 mm and 4 mm. On the one hand this thickness achieves the adequate mechanical stability for the embedding of the components of the operating element; on the other hand such a thin embodiment still firstly permits a good permeability of the optical signals of the display field and minimizes the installation depth of the cover.

Provision is preferably made for the top side of the annular front part of the operating element to be made of metal. A metal layer can be applied here for instance. Provision can however also be made for the front part to be made entirely of metal. In one embodiment with a metallic top side, a high-quality impression is imparted on the one hand and minimal wear is ensured on the other hand.

Provision is preferably made for the movable operating element to be arranged at least in regions within the surface area of the electronic display field. The free maneuverability of the operating element on the one hand and the nevertheless multiple and digital or dynamically alternating display of information on the electronic display field very closely adjacent to the operating element can be achieved as a result.

Provision is preferably made for the information to be displayed to be changeable on at least one field area of the display field as a function of the movement of the operating element. Therefore in this context different menu interfaces can be shown on the electronic display field. The menu interfaces can be accessed and selected as a function of the rotational position of the operating element. Provision can also be made for the menu interfaces displayed in principle then to be displayed with further menu contents when chosen by means of a specific rotational position of the operating element. Provision is preferably made for a menu interface to be displayed to be displayable or displayed on the display field about the operating element.

Furthermore the invention relates to a domestic appliance with an inventive operating device or an advantageous embodiment thereof. The domestic appliance is embodied in particular for the preparation of food or to care for laundry items or to clean dishes. Exemplary domestic appliances in this context may be an oven, a washing machine, a tumble dryer, a dishwasher, a refrigerator, a chest freezer or suchlike.

Further features of the invention will emerge from the claims, the figures and the description of the figures. The features and combinations of features cited above in the description and also the features and combinations of features shown only in the figures and/or the features and combinations of features cited only in the description of the figures may be used not only in the combination indicated in each case but also in other combinations or alone, without departing from the scope of the invention.

BRIEF DESCRIPTION OF THE DRAWINGS

Exemplary embodiments of the invention are explained in more detail below on the basis of the schematic drawings, in which.

DETAILED DESCRIPTION OF EXEMPLARY EMBODIMENTS OF THE PRESENT INVENTION

Figure 1:
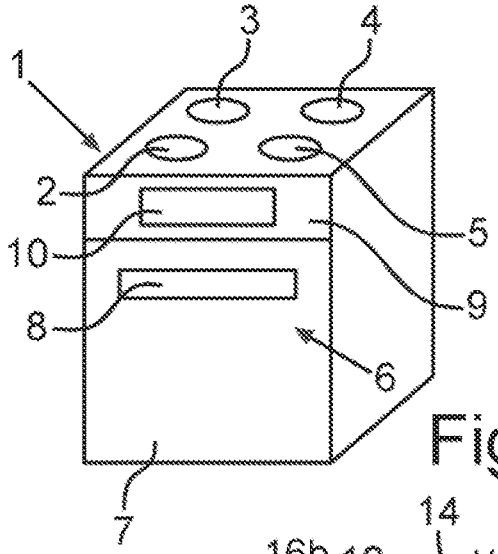
FIG. 1 shows a schematic perspective representation of an exemplary embodiment of an inventive domestic appliance.

In the figures, identical or functionally similar elements are provided with the same reference characters.

FIG. 1 shows a simplified schematic representation of a domestic appliance embodied as an oven 1. The oven 1 comprises four cooking zones 2, 3, 4 and 5 and a cooking compartment 6, which can be closed by a door 7, which has a handle 8 on the exterior. In the exemplary embodiment a control panel 9 with an operating device 10 is arranged above the door 7. Both the position and also the embodiment of the control panel 9 serve merely as examples.

Figure 2:
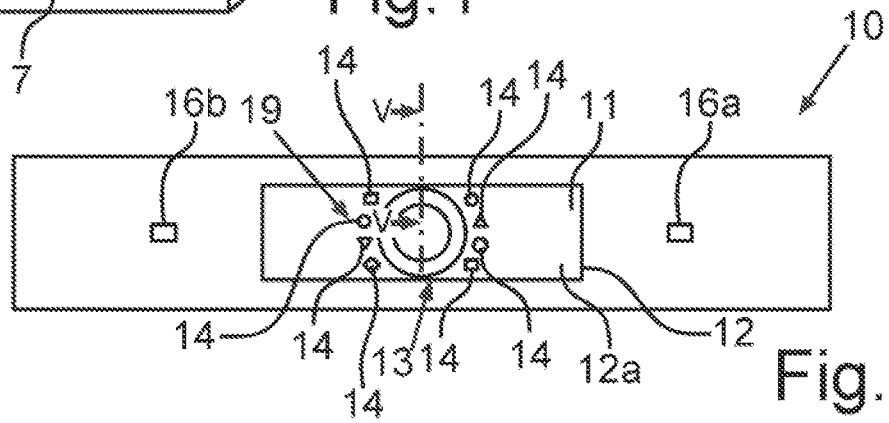
FIG. 2 shows a schematic front view of an exemplary embodiment of an inventive operating device.

FIG. 2 shows a simplified representation of a front view of an exemplary embodiment of the operating device 10. The operating device 10 comprises an electronic display field 11, which is embodied as a display. Information can be displayed in a dynamically changeable manner on the display field 11, the area of which is delimited by the edge or the boundary 12, which is configured to be rectangular in the exemplary embodiment. Different information in the form of letters and/or digits and/or symbols can be displayed on a screen of this type.

The operating device 10 furthermore comprises an operating element 13 which is a rotary selector in the exemplary embodiment. As can be seen from the representation in FIG. 2, the rotary selector 13 with its surface areas projected into the plane shown in the figure, viewed from the front, is arranged completely inside the surface area 12*a* with the boundary 12 of the electronic display field 11. It is thus positioned in effect entirely embedded in the planar areas of the display field 11. The operating element 13 can be moved in relation to the display field 11 on account of its embodiment as a rotary selector. By rotating the operating element 13, the operating conditions of the oven 1 associated therewith are set. As can be seen, an information display which in FIG. 2 takes the form of symbols 14, is embodied adjacent to and at least in ring sections around the annular operating element 13. The number of symbols 14 is only specified by way of example. Provision can also be made for digits and/or letters to be displayed instead of symbols 14. The information around the annular operating element 13 also represents menu interfaces in an alternative embodiment for instance, which then define a certain folder structure. The information then displayed can represent a category for a folder for instance, which contains further information. If a folder of this type is then accessed on the basis of the type of rotation of the operating element 13, the menu content can be displayed in further detail.

As can be seen in the exemplary embodiment according to FIG. 2, two controls 16*a* and 16*b* are embodied outside of the surface area 12*a* with the boundary 12 of the display field 11. These controls 16*a* and 16*b* are embodied as touch-sensitive control panels in the exemplary embodiment. On the one hand they can comprise a functional switching-on and switching-off of the oven 1 for instance. Provision can also be made additionally or alternatively for at least one of the controls 16*a* or 16*b* to be embodied to set an information depth of an item of menu content to be displayed on the display field 11. This means that the information, as is shown in FIG. 2 as symbols 14 or as menu categories of a menu interface, can be changed by one of the controls 16*a* or 16*b*. Where appropriate it can thus be set that a category, to be displayed, of a folder is not the high-level main folder, but rather a lower folder structure is already shown and a sub-folder is displayed as an initial setting for instance.

Provision can also be made for the control 16*a* and/or 16*b* to be arranged within the surface area 12*a* with the boundary 12 of the display field 11.

Figure 3:
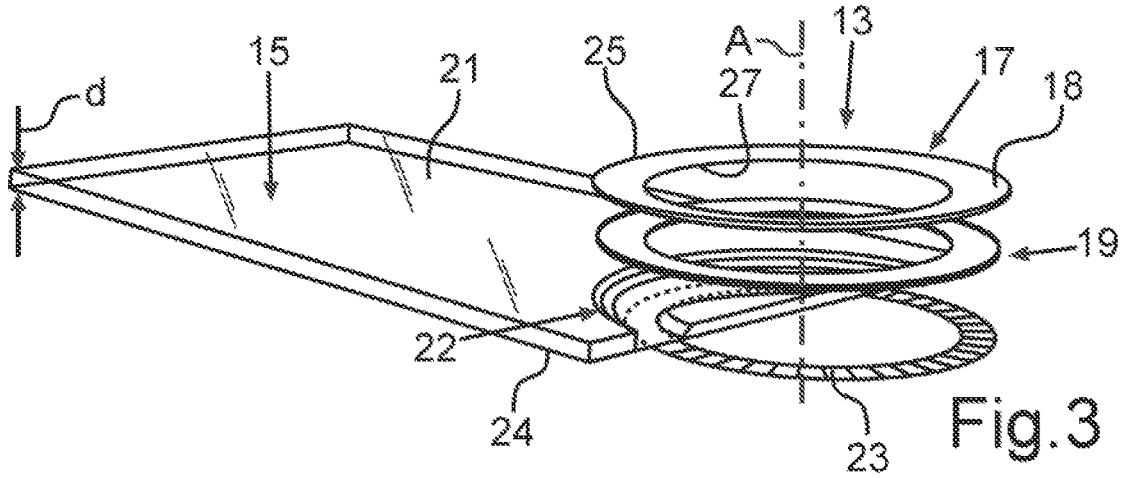
FIG. 3 shows a cross-section through subcomponents of the operating device according to the representation in FIG. 2.

In a perspective representation in FIG. 3 the cover 15 indicated in FIG. 2 in the form of a glass plate is partially shown. The cover 15 is shown with a cross-section in the region of the operating element 13. The operating element 13 is shown in an exploded representation. As it can be seen, the operating element 13 is made of multiple parts, comprising an annular front part 17, which has a front panel or top side 18. The top side 18 is inclined obliquely inward so that the top side 18 in effect produces a funnel shape of the front part 17. The oblique inward inclination is preferably between 3° and 15° compared to the plane in which the annular front part 17 extends. In the exemplary embodiment, the front part 17 is embodied in one piece as an aluminum component.

The operating element 13 furthermore comprises a sliding ring 19, which is arranged below or behind the front part 17 in the direction of a longitudinal axis A of the operating element 13. It is likewise embodied in one piece and manufactured from a particularly low-friction material. The front part 17 can be rotated in relation to the sliding ring 19. The sliding ring 19 has a fixed position and is thus arranged in a fixed manner on the control panel 9, in particular glued or non-detachably fastened thereto in a non-destructive manner by ultrasonic welding or hot stamping.

The sliding ring 19 and the front part 17 are held in an annular groove 22 embodied in an exterior 21 of the cover 15, wherein the sliding ring 19 with a slide plate 19*a* (FIG. 5) is preferably arranged so as to rest on a groove base 20 of the groove 22 which opens axially forward when viewed in the axial direction and thus in the direction of the axis A of the operating element 13.

The rotational position in relation to a fixed metal spider 23 is registered by means of magnets which can also be arranged in multiples on, and equidistantly in the peripheral direction of, the front part 17. In accordance with the representation in FIG. 3, the metal spider 23 is likewise embodied as a ring which has a thickness of approximately 0.7 mm.

Provision is preferably made for an annular groove, in which the metal spider 23 is arranged, likewise to be embodied on a rear 24 of the cover 15. The concept of the metal spider comprises the ring form with the spider-type or spike-type elevations and/or radial extensions.

Material of the cover 15 and thus glass material is provided for the metal spider 23 between the groove 22 and the groove 26 (FIG. 4) embodied on the rear 24, so that in this respect no continuous hole or no continuous recess is formed.

The thickness D of the cover 15, which in particular represents a rectangular glass plate, is 4 mm in the exemplary embodiment.

Provision can also be made for the front part 17 and the sliding ring 19 to be embodied, at least in regions, to be permeable to light in the spectral range which is visible to humans. This means that at least ring sections of the front part 17 and of the sliding ring 19 can be backlit.

The rotational position of the sliding ring 19 and of the front part 17 in relation to the metal spider 23 can be detected by means of a control unit (not shown) and thus the specific rotational position and thus the relative position in relation to the cover 15 and thus also in relation to the display field 11 can be registered and the associated operating condition setting can be identified and executed.

Figure 4:
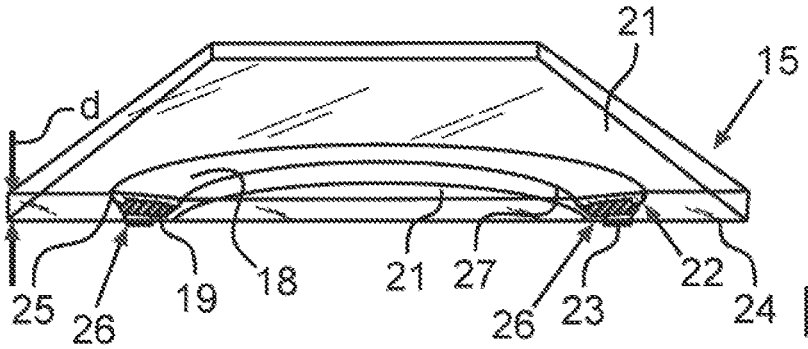
FIG. 4 shows an exploded representation of the drawing in FIG. 3.

The representation in FIG. 3 is shown in the assembled state in FIG. 4. It can be seen here that an outer edge 25 of the annular front part 17 projects approximately 0.5 mm beyond the exterior 21. The top side 18 which runs obliquely inward and downward can likewise be seen. Furthermore, the groove 26 for the metal spider 23 is also shown. In respect of an inner edge or a radially inner shell 27 of the annular front part 17, this can be flush with the exterior 21. On account of the top side 18 which runs inward obliquely downward, provision is then made for this subregion of the exterior 21 which is enclosed by the operating element 13 to be downwardly offset compared to the region of the exterior 21 embodied outside of the annular front part 17. Provision can however also be made for this inner edge 27 likewise to be arranged so as to project slightly beyond this subregion of the exterior 21 which is enclosed by the front part 17. The cover 15 is arranged at least in regions in front of the electronic display field 11 and is permeable to optical signals and information of the display field 11.

The subregion of the exterior 21 enclosed by the annular operating element 13 is preferably also embodied as the display region of the display field 11.

As already mentioned briefly above, the front part 17 can be rotated in relation to the sliding ring 19. In accordance with the representation in FIG. 5, which shows a cross-section along the line of intersection V-V in FIG. 2, the front part 17 and the sliding ring 19 are coupled by a guide 28. As a result, the front part 17 can be rotated in a guided manner in relation to the sliding ring 19. By means of the guide the front part 17 can furthermore not be unintentionally released from the sliding ring 19 and can thus also not fall out unintentionally, which is particularly advantageous when transporting the operating device 10.

The guide 28 comprises an open groove 29, viewed in the radial direction of the operating element 13 and thus also in the radial direction of the front part 17, which opens inward in this radial direction. This means that the groove 29 is thus oriented such that it is closed in the axial direction and thus in the direction of the axis A (FIG. 3) and has its opening or is accessible in the radial direction at right angles thereto. In the exemplary embodiment this radially open groove 29 is embodied on the shell side 27 of the front part 17 which is positioned further inward when viewed in the radial direction.

Furthermore, the guide 28 also comprises at least one further engaging element 30. The engaging element 30 may be an element embodied partially about the axis A in the peripheral direction; it may however also be a completely revolving engaging element.

The engaging element 30 is embodied integrally on the sliding ring 19. To this end, aside from a slide plate 19*a* the sliding ring 19 comprises a holding web 19*b* arranged thereon, on which this engaging element 30 is in turn then molded. In the exemplary embodiment, the engaging element 30 extends further outward in the radial direction of the operating element 13, compared to the holding web 19*b*, so that in this respect it can engage in the open groove 29 facing this or extends therein.

The engaging element 30 is preferably embodied resiliently and can thus be elastically deformed especially in the radial direction. Provision is made in particular for the engaging element 30 to be arranged in, and prestressed in the state coupled to, the groove 29, in particular arranged prestressed radially therein.

Figure 5:
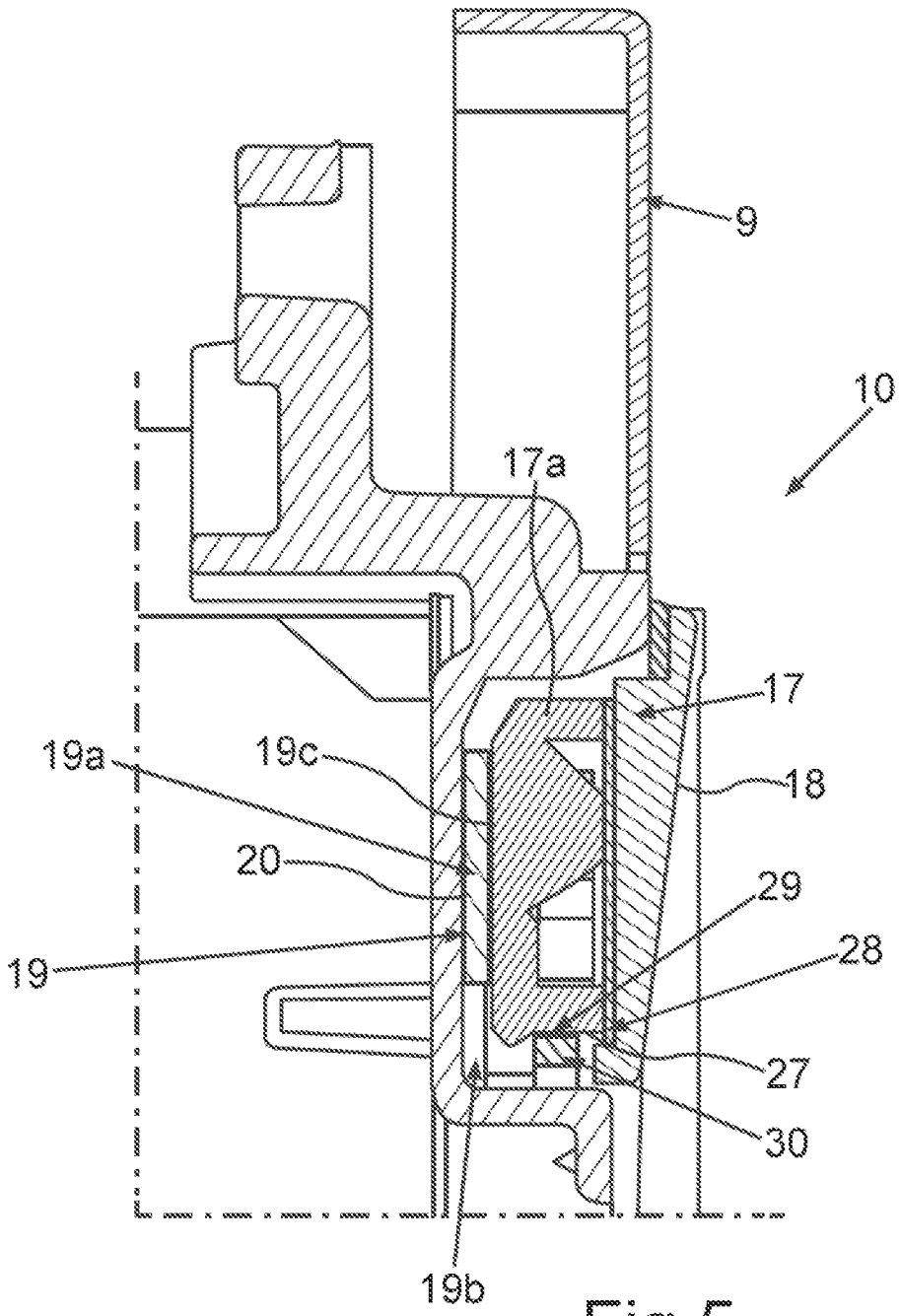
FIG. 5 shows a cross-section of the operating device according to FIG. 2.

As can be seen from the representation in FIG. 5, when the operating device 10 is viewed from the front, the slide plate 19*a* is arranged behind the front part 17 when viewed in the axial direction, and the front part 17 rests on a sliding surface 19*c* of this slide plate 19*a*. This sliding surface 19*c* may be flat or may also be embodied with dimples.

The operating element 13 is guided in the control panel 9 and is centered and held there in a virtually play-free manner. This relates in particular to the front part 17. A material pairing which is suitable for easy motion control is preferably embodied between the slide plate 19*a* and the front part 17, in particular a rear element 17*a* of the front part 17 which rests directly on the slide plate 19*a*.

Furthermore this means that breakthroughs in the slide plate 19*a* can also be configured to generate the engaging element or elements 30, without negatively affecting safety requirements, for instance the accessibility of live parts.

A form closure is preferably embodied between the engaging element 30 and the groove 29 and a form closure is furthermore also realized between the sliding surface 19*c* and the rear element 17*a*. The degree of the form closure in the radial direction is preferably embodied such that a freedom from play is achieved and on the other hand operation of the ring by the user is easily permitted. The degree of the form closure in the axial direction is embodied in particular such that pull-off forces are large enough to ensure that the front part 17 is held securely on the device 1 even with relative movements of the control panel 9 or during transportation and are small enough to be able to remove the front part 17 for cleaning purposes for instance.

Provision can also be made for the groove 29 to be embodied on the sliding ring 19 and for an engaging element 30 then positioned facing radially inwards to be embodied in particular on the shell side 27 so that compared to the representation in FIG. 5, the inverse embodiment is realized.

The invention claimed is:

1. An operating device for a domestic appliance, comprising:

an electronic display field;

a guide; and an operating element configured for movement relative to the electronic display field to set operating conditions of the domestic appliance, said operating element comprised of multiple parts and including a sliding ring and a front part resting on the sliding ring, a part of the sliding ring being arranged behind the front part and the guide in an axial direction, said front part and said sliding ring being coupled to the guide such that the front part is rotatable in a guided manner relative to the sliding ring by the guide.

2. The operating device of claim 1, wherein the guide has a groove which opens in a radial direction of the operating element, said guide including at least one engaging element.

3. The operating device of claim 2, wherein the at least one engaging element is configured to be resilient in the radial direction of the sliding ring and of the front part.

4. The operating device of claim 2, wherein the at least one engaging element is arranged in the groove and coupled in the groove in a prestressed manner.

5. The operating device of claim 4, wherein the at least one engaging element is prestressed in a radially direction.

6. The operating device of claim 2, wherein the groove is formed on a radially inner shell side of the front part.

7. The operating device of claim 1, wherein the sliding ring includes a slide plate, which is arranged behind the front part in the axial direction of the operating element, and includes a holding web, which extends in the axial direction so as to overlap the front part, and further comprising at least one engaging element formed on the holding web and extending in a radial direction into the groove.

8. The operating device of claim 1, wherein the sliding ring has a fixed position on a control panel of the domestic appliance.

9. The operating device of claim 1, wherein the front part has a top side inclined inward.

10. The operating device of claim 1, wherein the operating element is configured as a rotary selector.

11. The operating device of claim 1, wherein the front part is configured as a ring having a top side which faces away from the sliding ring and is inclined inward in relation to a plane in which the front part extends.

12. A domestic appliance, comprising an operating device, said operating device including an electronic display field, a guide, and an operating element configured for movement relative to the electronic display field to set operating conditions of the domestic appliance, said operating element comprised of multiple parts and including a sliding ring and a front part resting on the sliding ring, a part of the sliding ring being arranged behind the front part and the guide in an axial direction, said front part and said sliding ring being coupled to the guide such that the front part is rotatable in a guided manner relative to the sliding ring by the guide.

13. The domestic appliance of claim 12, wherein the guide has a groove which opens in a radial direction of the operating element, said guide including at least one engaging element.

14. The domestic appliance of claim 13, wherein the at least one engaging element is configured to be resilient in the radial direction of the sliding ring and of the front part.

15. The domestic appliance of claim 13, wherein the at least one engaging element is arranged in the groove and coupled in the groove in a prestressed manner.

16. The domestic appliance of claim 15, wherein the at least one engaging element is prestressed in a radially direction.

17. The domestic appliance of claim 13, wherein the groove is formed on a radially inner shell side of the front part.

18. The domestic appliance of claim 12, wherein the sliding ring includes a slide plate, which is arranged behind the front part in the axial direction of the operating element, and includes a holding web, which extends in the axial direction so as to overlap the front part, and further comprising at least one engaging element formed on the holding web and extending in a radial direction into the groove.

19. The domestic appliance of claim 12, further comprising a control panel, said sliding ring having a fixed position on the control panel.

20. The domestic appliance of claim 12, wherein the front part has a top side inclined inward and/or the operating element is configured as a rotary selector.

21. The domestic appliance of claim 12, wherein the front part is configured as a ring having a top side which faces away from the sliding ring and is inclined inward in relation to a plane in which the front part extends.

* * * * *